US009309039B2

(12) United States Patent
Kellner

(10) Patent No.: US 9,309,039 B2
(45) Date of Patent: Apr. 12, 2016

(54) ARTIST'S PALETTE ACCESSORY AND PAINT STORAGE SYSTEM

(71) Applicant: Patricia Kellner, Redondo Beach, CA (US)

(72) Inventor: Patricia Kellner, Redondo Beach, CA (US)

( * ) Notice: Subject to any disclaimer, the term of this patent is extended or adjusted under 35 U.S.C. 154(b) by 0 days.

(21) Appl. No.: 14/313,979

(22) Filed: Jun. 24, 2014

(65) Prior Publication Data

US 2014/0332420 A1 Nov. 13, 2014

Related U.S. Application Data

(63) Continuation-in-part of application No. 14/084,599, filed on Nov. 19, 2013, now abandoned.

(60) Provisional application No. 61/796,896, filed on Nov. 20, 2012.

(51) Int. Cl.
*B65D 81/26* (2006.01)
*B44D 3/02* (2006.01)
*B44D 3/04* (2006.01)

(52) U.S. Cl.
CPC ..... *B65D 81/264* (2013.01); *B44D 3/02* (2013.01); *B44D 3/04* (2013.01)

(58) Field of Classification Search
CPC ..... B65D 81/264; B65D 81/26; B44D 3/02; B44D 3/04; B44D 3/00; B44D 3/12
USPC ..... 206/1.7, 204, 1.8, 575
See application file for complete search history.

(56) References Cited

U.S. PATENT DOCUMENTS

| | | | | | |
|---|---|---|---|---|---|
| 2,325,380 | A * | 7/1943 | Edwards, Jr. | 422/41 |
| 3,411,617 | A * | 11/1968 | Kingdon | 206/1.7 |
| 3,877,572 | A * | 4/1975 | Wiener, Jr. | 206/226 |
| 3,885,843 | A * | 5/1975 | Rubel | 312/31 |
| 3,918,578 | A * | 11/1975 | Cullen et al. | 206/204 |
| 4,180,159 | A * | 12/1979 | Tanaka | 206/63.5 |
| 4,444,306 | A * | 4/1984 | Benaquista | 206/1.7 |
| 5,301,799 | A * | 4/1994 | Gurba, Jr. | 206/1.7 |
| 5,440,853 | A * | 8/1995 | Engdahl | 53/432 |
| 5,573,116 | A * | 11/1996 | Zink | 206/378 |
| 5,715,933 | A * | 2/1998 | Monahan | 206/1.7 |
| 6,302,267 | B1 * | 10/2001 | Monahan | 206/1.7 |
| 6,325,206 | B1 * | 12/2001 | Stonex | 206/1.8 |
| 6,367,620 | B1 * | 4/2002 | Kelifa | 206/1.9 |
| 7,416,080 | B1 * | 8/2008 | Langer | 206/361 |

* cited by examiner

*Primary Examiner* — Steven A. Reynolds
(74) *Attorney, Agent, or Firm* — George P. White

(57) ABSTRACT

This palette accessory and paint storage system keeps oil paint fresh and pliable for weeks at room temperature. A linear paint tray, upon which daubs of paint are placed, is stored inside an airtight tube. Felt wicks mounted inside the end caps hold clove oil, which prevents the oxidation of oil paints. For heavy bodied acrylics, the end caps are mounted with sponge material or silica gel that would be moistened to create a humid environment that prevents acrylics from drying and hardening. When the artist is ready to paint, the paint tray is removed from the storage tube and secured with clips or Velcro to a mixing palette, paint box, or easel. The painter dips into the paint daubs on the tray to mix the desired colors on their palette. When done painting, the paint tray, with the unused paint, is re-inserted into the tube for storage and transport.

10 Claims, 4 Drawing Sheets

ARTIST'S PALETTE ACCESSORY AND PAINT STORAGE SYSTEM

This application claims the priority from U.S. non-provisional application Ser. No. 14/084,599, filed on Dec. 30, 2013, as a continuation in part of that application, which in turn, claims the benefit of U.S. provisional application No. 61/796,896 entitled "Artist's Palette and Storage System", filed on Nov. 20, 2012, and hereby incorporates both applications in their entirety herein.

BACKGROUND

Oil and acrylic painting, both in studio and outdoors, is becoming a very popular pastime. One of the less appealing tasks involved with painting is that of setting up your palette with the desired colors of oil or acrylic paint and the cleanup once one is finished with a painting session. Artists frequently place a line of fresh paint daubs squeezed from paint tubes along the edge of their palette, paint box, or easel box. They then pick up paint from the daubs to mix together on the palette surface to form the desired colors. Paint is expensive, and artists try and anticipate how much paint they will need of each color. Because acrylic paint dries out within a few hours of leaving the tube, and oil paint hardens through oxidation after a day or so outside the paint tube, artists frequently have to either throw away the paint that remains at the end of a painting session, or try and preserve it for a day or two. Some paint storage systems require that the paint be transferred with a palette knife from the palette into the paint storage container that then must be placed in the freezer if paint is to be saved for more than a couple of days. A lot of paint is lost in the process of moving the paint daubs from one location to another and it is an inconvenient and messy process. A better solution is needed for this problem.

SUMMARY

A solution to the problem of providing a preserving storage accessory for artist paints on a pallet includes the pallet being a tray that fits into a container in a manner which supports the paint on the pallet in a region that will not touch the inner walls of the container during normal use and transportation. Additionally, the container can also hold a paint preservative in a location such that the preservative does not come into direct physical contact with the paint. Fumes emitted from the preservative can contact the paint. The preservative might be a volatile oil that emits fumes, or a humectant that emits water vapor. The paint preservative can operate by emitting fumes that serve to either prevent oxidation or evaporation of the paint. The container being completely or at least partially airtight contributes to performance.

One mechanical configuration is a V-shaped tray placed in a clear, cylindrical container with end caps. One or both of the end caps can retain a preservative. With appropriate relative sizes between a tray and a container, and with one portion of the tray differentially weighted from other portions of the tray, gravity will turn the tray within the container to keep the paint facing upwards. In another mechanical configuration, the tray has two opposing sides that are curved as a portion of a circle of a slightly smaller diameter than that of the cylindrical container.

For oil paint, a felted wool wick can be moistened with preservative such as an anti-skinning, anti-oxidizing agent. An example can be clove oil (clove leaf oil, clove bud oil, or clove stem oil). Eugenol, which is the volatile component of the clove oil, will slowly evaporate from the wick and keep the daubs of oil paints fresh for weeks at room temperature.

Likewise, acrylic paints, which dry out instead of oxidizing, can be kept moist by adding water to silica gel pillows or sponges mounted inside the end caps (instead of the felt wicks used for a volatile oil). This moistened sponge or gel can maintain a humid environment for daubs of heavy body acrylic paints.

This palette accessory has a paint tray, on which the artist places daubs of paint squeezed from a paint tube. This paint tray is then attached to a traditional palette or paint box, conveniently keeping the daubs of paint separate from the mixing surface. Using a palette knife or brush, the artist grabs bits of paint from the daubs, as needed, to mix desired colors on the palette surface. After the artist is done painting, the paint tray, with all remaining daubs of oil or acrylic paints, slides easily and cleanly inside the substantially airtight storage tube and the end caps are placed on the ends of the tube. The remaining paint daubs are now ready for transport and will be prevented from oxidizing, skinning over, or drying out by the substance contained within the end caps. These systems can allow the artist to stop work on a painting for several days or weeks and return to the same selection of paints that were on the paint tray when the painting session ended.

OVERVIEW

The palette accessory and paint storage systems presented improve the painting experience, allowing the artist to save time (no need to squeeze out all new fresh paint) and money (no need to discard good paint at the end of a painting session). The paint tray containing the daubs of paint is clipped or attached using Velcro to a paint box or mixing palette, or easel surface. Because any excess paint can be preserved for weeks, the painter is free to place more generous amounts of paint on the paint tray—enough for several paintings, and thus eliminate the interruption of having to squeeze more paint out during a painting session. When necessary, the artist can add new paint to supplement the older paint on the paint tray before a painting session begins. When the artist paints outdoors, it is no longer necessary to bring along all the heavy tubes of paint colors as sufficient paint can be placed on the paint tray ahead of time. Also, while spending several days painting in the field, there is no need to store oil paints in a freezer as the eugenol in the clove oil prevents oxidation at room temperature.

Once finished with a painting session, the paint tray containing the remaining paint is easily moved as a single unit and placed inside the storage tube until the next painting session—perhaps weeks later. This system has an additional benefit of keeping both the artist's clothing and supplies cleaner and free from errant daubs of paint. The combined system of storage tube, paint tray and end caps make for an efficient and compact manner of storing and transporting paint that has been removed from a paint tube.

First Embodiment

In this first embodiment, the tray is v-shaped and rests in a clear cylindrical tube with end caps. The tray is about the length of the tube and fits in such that the paint is not touching the inner sidewalls. Felt wicks are mounted in the center of the end caps in a location to the side of and above the daubs of oil paint on the tray. This prevents the clove oil itself from touching the paint. This can be important, as paint mixed with clove oil can change the characteristics of the oil paint in a way that is not desirable to most painters. Instead, only the volatile component of the clove oil, eugenol, evaporates into the air space of the storage tube and thus affects only the outermost layer of the paint daubs, preventing the paint from forming a skin and hardening through oxidation.

Figure 1:
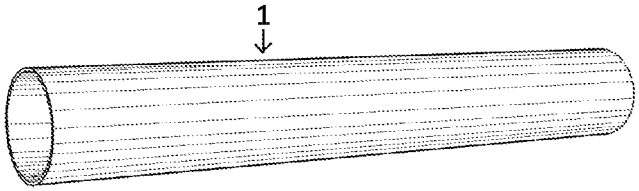
FIG. 1 is a perspective view of the elongated storage tube of the first embodiment, which is cylindrical.
Figure 2:
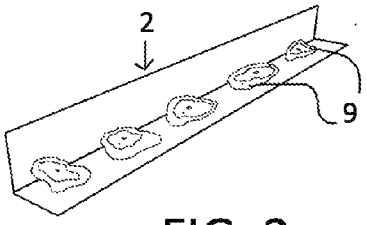
FIG. 2 is a perspective view of an elongated paint tray on which daubs of paint are placed. This paint tray is designed to fit inside the tube illustrated in FIG. 1.
Figure 3:
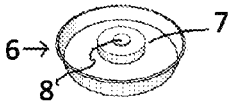
FIG. 3 is a perspective view of one end cap onto which wool felt wick has been mounted.
Figure 4:
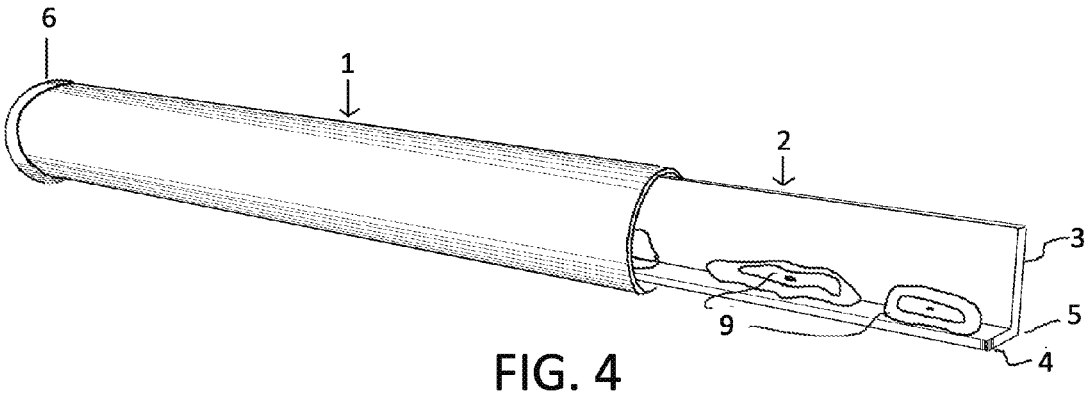
FIG. 4 is a perspective view showing the paint tray partially inserted into the tube; one end cap has been placed on the left end of the tube, but the end-cap for the other end of the tube is not shown.

In more detail:

This palette accessory and paint storage system seen in FIG. 4 includes a clear plastic storage tube 1, a plastic paint tray 2, and two end caps 6. The end caps have been fitted with round wool felt wicks 7. The wicks shown in FIG. 4 are ¾" diameter, and ¼ inches deep. The felt wick is attached to the end cap 6 using a Chicago binding screw 8 or other fastener. Due to the nature of the clove oil used with the wicks a mechanical binding is a preferable to an adhesive as a fastening approach.

The paint tray has two surfaces 3 and 4 that intersect at a vertex 5. In this first embodiment the two surfaces 3 and 4 together can be seen as forming the perpendicular sides of a right triangle, the hypotenuse of which is slightly less in length than the diameter of the tube. In this embodiment the tube has an inner diameter of 1.65 inches and each surface 3 and 4 of the paint tray is 1.125 inches wide, although other sizes that allow the hypotenuse to be smaller than the tube diameter would work. This configuration allows the paint tray to rotate easily within the tube while minimizing the volume of air space. Daubs of paint 9 are squeezed out of paint tubes and deposited onto the paint tray 2 in the vertex of the triangle made by the surfaces 3 and 4. The vertex is the heaviest portion of the tray when in use, because it is filled with paint daubs. The tray always comes to rest in a position where the daubs are facing upward, even if the tube is rotated along a horizontal axis. This configuration prevents the paint from contacting the surface of the tube.

Figure 5:
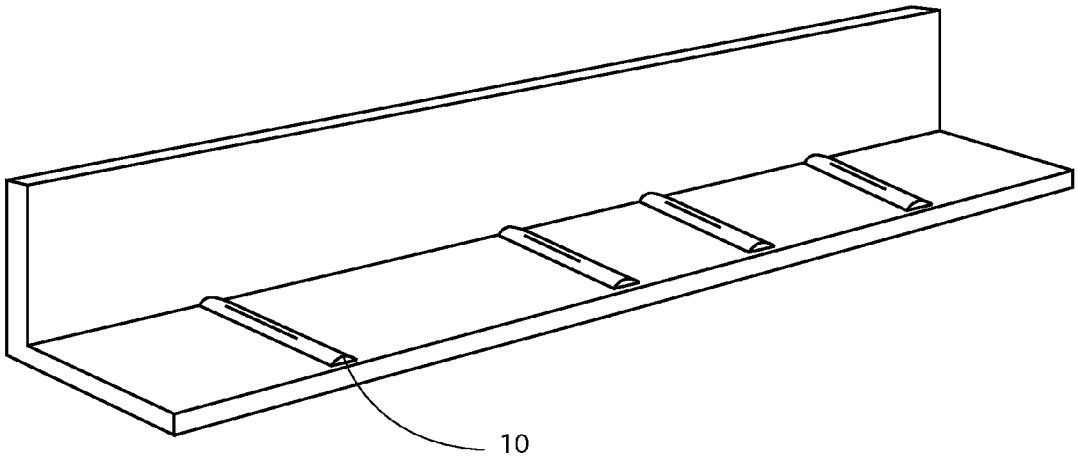
FIG. 5 is a perspective view showing a paint tray with dividers.
Figure 6:
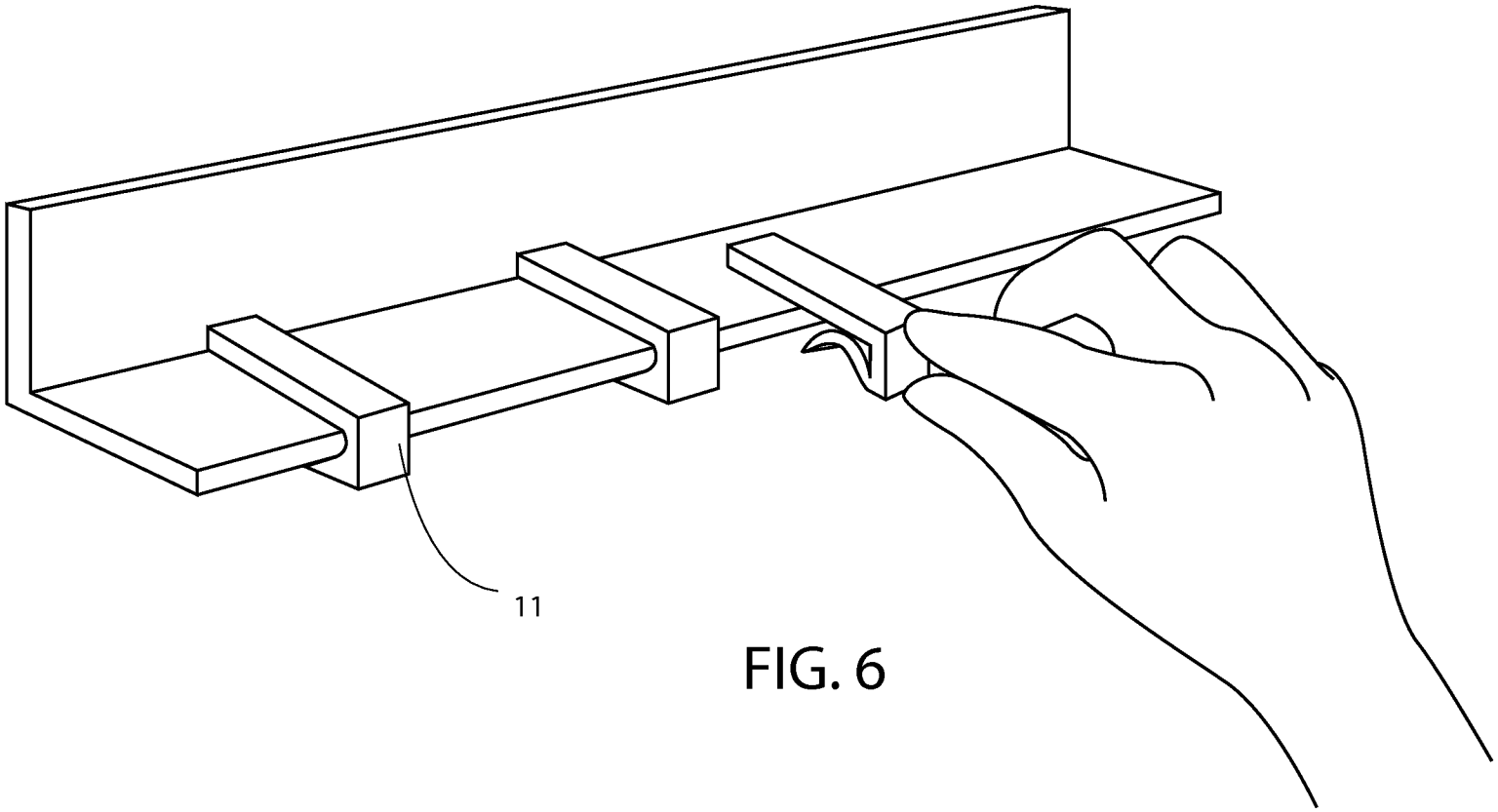
FIG. 6 is a perspective view showing a paint tray with clips that act as paint dividers.

In this embodiment, both planes of the V-shaped paint tray are smooth. In the tray version seen in FIG. 5 there are integral dividers 10 that can keep different paints separated. Clip dividers 11 as seen in FIG. 6 could be added to separate the paint tray into arbitrarily sized divided segments for individual colors. The clips or other protrusions also serve the function of keeping the inside of the tube from touching the paint. Often, artists use differing amounts of different colors, for instance, preferring a large daub of ultramarine blue, but only a very small daub of thalo green. The clip-on dividers would allow the artist to customize the paint tray by creating the divisions they desire. A typical daub of paint would fit in a 1 inch×1 inch×½ inch high space.

In this embodiment the end caps 6, provide an essentially airtight friction fit on the outside of the tube 1, although variations and alternative embodiments could employ end caps that go inside of the tube as plugs, screw on, have a gasket and clip system, or some other closure system. Likewise, although a clear plastic tube is used in this embodiment, an appropriately sized tube of any non-porous material would work. The tube shown in the drawings is cylindrical, but another shape including, but not limited to, square or triangular could be used in an alternative embodiment but might not have all of the properties of a cylindrical version. In embodiment shown in FIG. 4 the tube is open at both ends, requiring two end caps 6. In a variation, it could be permanently closed on one end and only require one end cap on the opposing end.

Wool felt wicks 7 are attached to the inside of each end cap 6 to act as a clove oil reservoir. Clove oil will release the volatile component eugenol into the air space of the closed tube. Eugenol acts is an anti-oxidant that prevents the outermost molecular layer of the oil paint from oxidizing and forming a hardened skin. The presence of eugenol results in an anti-skinning action, allowing the oil paint to remain soft and pliable for weeks at room temperature. Without the eugenol or other effective vapors, the oil paint would begin to form a skin within 24 hours and become completely hardened in a few days. Because clove oil, if mixed directly with the paint, will prevent a painting from drying for months, it is desirable to only expose the surface of the oil paint daubs to the eugenol evaporate, not to the oil itself. If, instead, the clove oil made liquid contact with the paint it would change its character and drying time. Thus the wicks suspend the oil away from the paint while allowing for the release of the anti-oxidant eugenol. The artist's hands are protected from touching the clove oil as the wick is shrouded within the plastic end cap. Clove oil can be applied directly from the bottle to the wick, again, without having to contact clove oil.

Attention should be paid to using a retaining system not subject to the clove oil's property of dissolving most, if not all, adhesives.

An alternative embodiment of this paint storage system is for use with acrylic paints, instead of oil paints. This system would use sponges or gel pillows inside the end caps. Acrylic paints "dry out" instead of oxidizing, but if they are kept in a sufficiently humid environment, they can remain pliable and ready to use. The acrylic paints could be kept moist by adding water to gel pillows secured inside the end caps. The gel would contain a potassium-based cross-linked polymer, or other humectant. An even simpler method would be to add water to a sponge secured inside the end caps. Either approach would then maintain a humid environment and prevent acrylic paints from drying and hardening.

Second Embodiment

Figure 7:
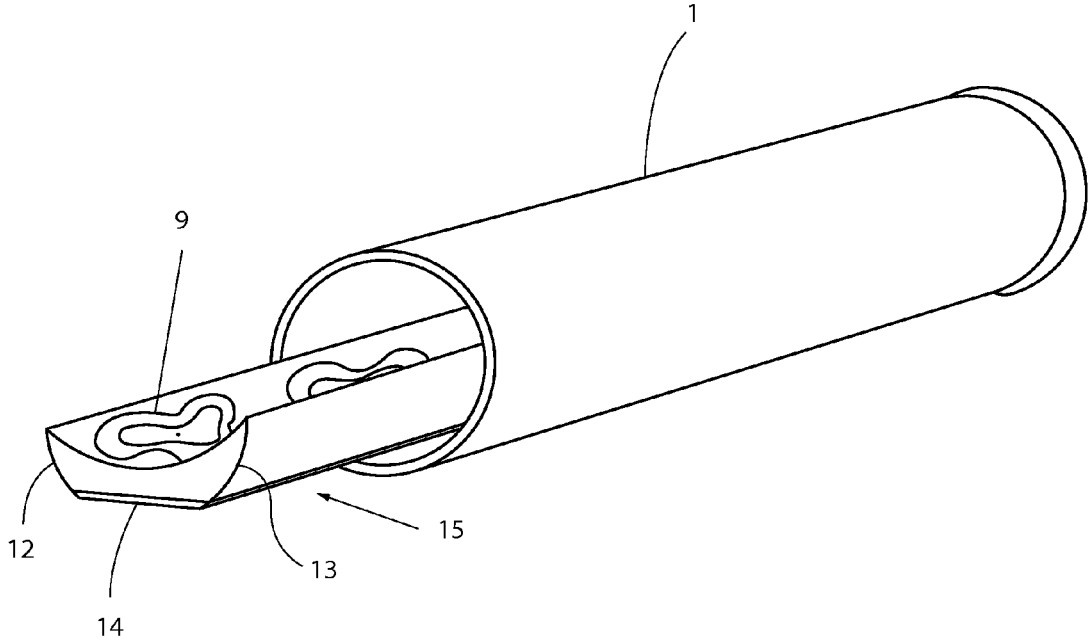
FIG. 7 is a perspective view of the elongated storage tube and tray of the second embodiment.
Figure 8:
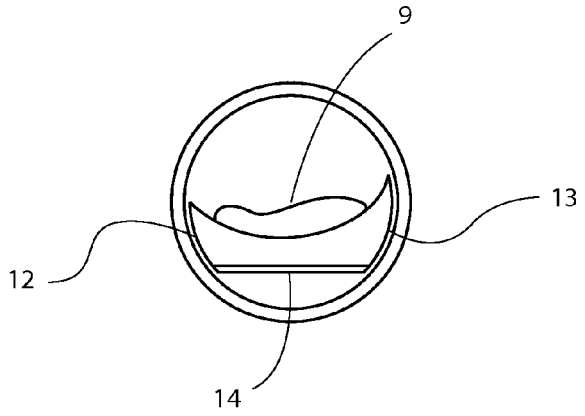
FIG. 8 is a side view of the elongated storage tube and tray of the embodiment of FIG. 7.

FIG. 7 shows another mechanical configuration where a tray 15 has two opposing sides 12, 13 that are curved, each a portion of a common circle of a slightly smaller diameter than that of the cylindrical container 1. The tray is appropriately weighted along a bottom, flat side 14 to insure that it rotates freely while remaining upright and keeping paint from spilling or smearing over. The flat bottom on the paint tray increases stability when removed from the tube and set on a horizontal surface to be used as a pallet.

The sides 12 and 13 are shown as asymmetric in order to provide a tray with access to the paint while painting. One side 12 is lower for easier access and the opposing side 13 is higher to serve as a ledge to help keep paint in the tray.

While the principles of this invention have been specified in the above paragraphs, other arrangements of size and proportion, materials used, and other departures from this preferred embodiment would come to mind by anyone of ordinary skill in the field of painting. Thus the following claims are intended to include any such modifications within the true spirit and scope of the invention.

It is claimed:

1. An apparatus for holding at least one daub of artist's paint comprising:

(a) an elongated container with a substantially airtight closure;

(b) an elongated tray with at least one elongated generally planar surface, the tray of a size, shape and configuration to fit into the container with the elongated dimensions of the tray and container aligned and where, in a closed, and generally horizontally disposed state, the generally planar surface of the tray is self-righting by the action of gravity and kept a minimum distance from the at least one surface due to the relationship between the tray's structure and the container's structure; and (c) at least one piece of an absorbent material secured on the inside of the container proximate to a terminus of the container such that when the container contains the tray and is closed, a liquid substance contained in the absorbent material will not be in liquid communication with daubs of paint that may be resting on a central region of the tray.

2. The apparatus of claim 1 where at least one of the at least one piece of absorbent material contains an absorbed liquid whose vapors have a paint preserving property.

3. The apparatus of claim 2 where the absorbed liquid is a volatile substance that produces Eugenol.

4. The apparatus of claim 2 where the liquid comprises clove oil.

5. The apparatus of claim 2 where the absorbent material is secured in place by a fastener substantially unaffected by clove oil.

6. The apparatus of claim 1 where the container is a cylinder and the tray is an elongated V-shape of substantially the inside length of the container.

7. The apparatus of claim 1 where the container is a tube.

8. The apparatus of claim 7 where the absorbent material is secured inside an end cap.

9. The apparatus of claim 7 where the tubular container is a cylinder, the tray has opposing sides in the minor axis direction that are portions of a circle of a diameter smaller than the inside diameter of the tube such that the tray rotates freely within the tube axially.

10. The apparatus of claim 2 where the absorbed liquid is water.

* * * * *